US010433659B1

(12) United States Patent
Pedersen et al.

(10) Patent No.: US 10,433,659 B1
(45) Date of Patent: Oct. 8, 2019

(54) INTERACTIVE DISPLAY UNIT

(71) Applicant: Target Brands, Inc., Minneapolis, MN (US)

(72) Inventors: Sara L. Pedersen, Minneapolis, MN (US); Christopher S. Case, Shakopee, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 15/983,400

(22) Filed: May 18, 2018

(51) Int. Cl.
*A47F 5/00* (2006.01)
*A47B 53/00* (2006.01)

(52) U.S. Cl.
CPC ..... *A47F 5/0093* (2013.01); *A47F 5/0018* (2013.01); *A47B 53/00* (2013.01)

(58) Field of Classification Search
CPC ..... A47F 5/0093; A47F 5/0018; A47B 53/00; E04B 2/7416; E04B 2/827; E04B 2002/7483
See application file for complete search history.

(56) References Cited

U.S. PATENT DOCUMENTS 1,380,222 A * 5/1921 Lichtenberg ..... A47B 67/005 248/486
1,700,212 A 1/1929 Artt
2,098,828 A * 11/1937 Ludwick ..... A47B 53/00 104/121
2,817,444 A 12/1957 Brandell
3,295,695 A 1/1967 Carmstrom
3,335,874 A 8/1967 Levy et al.
3,425,568 A 2/1969 Albright
3,534,863 A 10/1970 Howard
3,537,769 A * 11/1970 Di Constantino ... A47B 83/045 108/161
3,570,679 A 3/1971 Edson
3,570,683 A * 3/1971 Dickgiesser ..... A47F 5/00 211/162
3,883,004 A * 5/1975 Slaga ..... A47F 5/0093 211/162
4,036,370 A * 7/1977 Chevalier ..... A47F 7/16 211/162
4,171,052 A * 10/1979 Winn ..... A47F 5/10 211/162
4,360,991 A * 11/1982 West ..... E04B 2/7416 312/286
4,898,283 A * 2/1990 Kingsford ..... A47F 5/0093 211/162
5,341,944 A * 8/1994 Latino ..... A47B 53/00 211/162

(Continued)

*Primary Examiner* — Ko H Chan
(74) *Attorney, Agent, or Firm* — Leanne Taveggia Farrell; Westman, Champlin & Koehler, P.A.

(57) ABSTRACT

An interactive retail display unit includes a movable case having a plurality of shelves, an upper rail assembly including a rail having a first end and an opposing second end and at least one bearing slidably coupling the movable case to the rail and a lower track and roller assembly. The lower track and roller assembly includes a track having a first end corresponding with the first end of the rail, an opposing second end corresponding with the second end of the rail and a plurality of wheels mounted to a bottom of the movable case. The movable case is configured to move along the rail and the track.

17 Claims, 9 Drawing Sheets

(56) References Cited

U.S. PATENT DOCUMENTS

| | | | | |
|---|---|---|---|---|
| RE35,047 | E * | 10/1995 | Potter | A47B 53/00 211/162 |
| 5,477,971 | A | 12/1995 | Howard | |
| 5,611,442 | A | 3/1997 | Howard | |
| 6,474,484 | B1 * | 11/2002 | Miller, Jr. | A47F 3/06 108/107 |
| 6,726,039 | B2 * | 4/2004 | Boron | A47F 3/06 108/107 |
| 6,976,598 | B2 | 12/2005 | Engel | |
| 7,516,853 | B1 | 4/2009 | Murillo, Jr. | |
| 7,581,650 | B1 | 9/2009 | Shen | |
| 7,900,784 | B1 | 3/2011 | Weigand et al. | |
| 7,950,331 | B2 | 5/2011 | Tourdot et al. | |
| 8,061,539 | B2 * | 11/2011 | Punzel | A47B 57/10 108/108 |
| 2004/0217076 | A1 | 11/2004 | Gallagher | |
| 2005/0230338 | A1 | 10/2005 | Farinola et al. | |
| 2005/0284829 | A1 | 12/2005 | Shaffer | |
| 2008/0237165 | A1 | 10/2008 | Bobis et al. | |

* cited by examiner

INTERACTIVE DISPLAY UNIT

BACKGROUND

Businesses, such as retail stores, use a variety of display structures to present products and related information to customers for purchase. Display shelves are components that are used with display structures to support merchandise that is being offered for sale.

The discussion above is merely provided for general background information and is not intended to be used as an aid in determining the scope of the claimed subject matter.

SUMMARY

An interactive retail display unit includes a movable case having a plurality of shelves, an upper rail assembly and a lower track and roller assembly. The upper rail assembly includes a rail having a first end and an opposing second end and at least one bearing slidably coupling the movable case to the rail. The lower track and roller assembly includes a track having a first end corresponding with the first end of the rail, an opposing second end corresponding with the second end of the rail and a plurality of wheels mounted to a bottom of the movable case that engages with the track. The movable case is configured to move along the rail and the track.

An interactive retail structure includes a fixed gondola display fixture and an interactive display unit. The fixed gondola display fixture includes a base deck having a top surface, a plurality of uprights and a back wall. The interactive display unit is mounted to the gondola display fixture and includes a movable case having a plurality of shelves, an upper rail assembly and a lower track and roller assembly. The upper rail assembly includes a rail mounted to the plurality of uprights and having a first end, an opposing second end and at least one bearing slidably coupling the movable case to the rail. The lower roller and track assembly includes a track mounted to the top surface of the base deck and having a first end corresponding with the first end of the rail and an opposing second end corresponding with the second end of the rail. The movable case is configured to move along the rail of the upper rail assembly and the track of the lower track and roller assembly relative to the fixed gondola display fixture to reveal merchandise located behind the movable case.

A method of interacting with a retail structure includes moving a movable case having a plurality of shelves that is mounted to a fixed gondola display fixture by sliding the movable case along a rail mounted to a plurality of uprights of the gondola display fixture and simultaneously rolling the movable case along a track mounted to a top surface of a base deck of the gondola display fixture. The moving of the movable case along the rail and the track includes revealing merchandise located behind the movable case that is displayed on rows of shelves mounted to the plurality of uprights of the fixed gondola display fixture.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Embodiments described herein are directed to an interactive display unit mounted to a fixed gondola display fixture in a retail store. The interactive display unit highlights merchandise located on one or more display shelves in a movable case to draw customer attention to and allow the customer to interact with the movable case. For example, the movable case includes one or more display shelves and may be a bookcase holding books being offered for sale. The bookcase rolls on a track from one end of the fixed gondola display fixture to an opposing end of the fixed gondola display fixture and may be positioned and repositioned by the customer or other user at any location there between. The interactive display unit also offers advantageous functions. By including a movable bookcase on a track at the front of the fixed gondola display fixture, more books can be displayed on the fixed gondola display fixture by also utilizing the space behind the movable bookcase for rows of shelves of books. Upon moving the movable bookcase, books on shelves behind the movable bookcase are revealed and become accessible.

Figure 1:
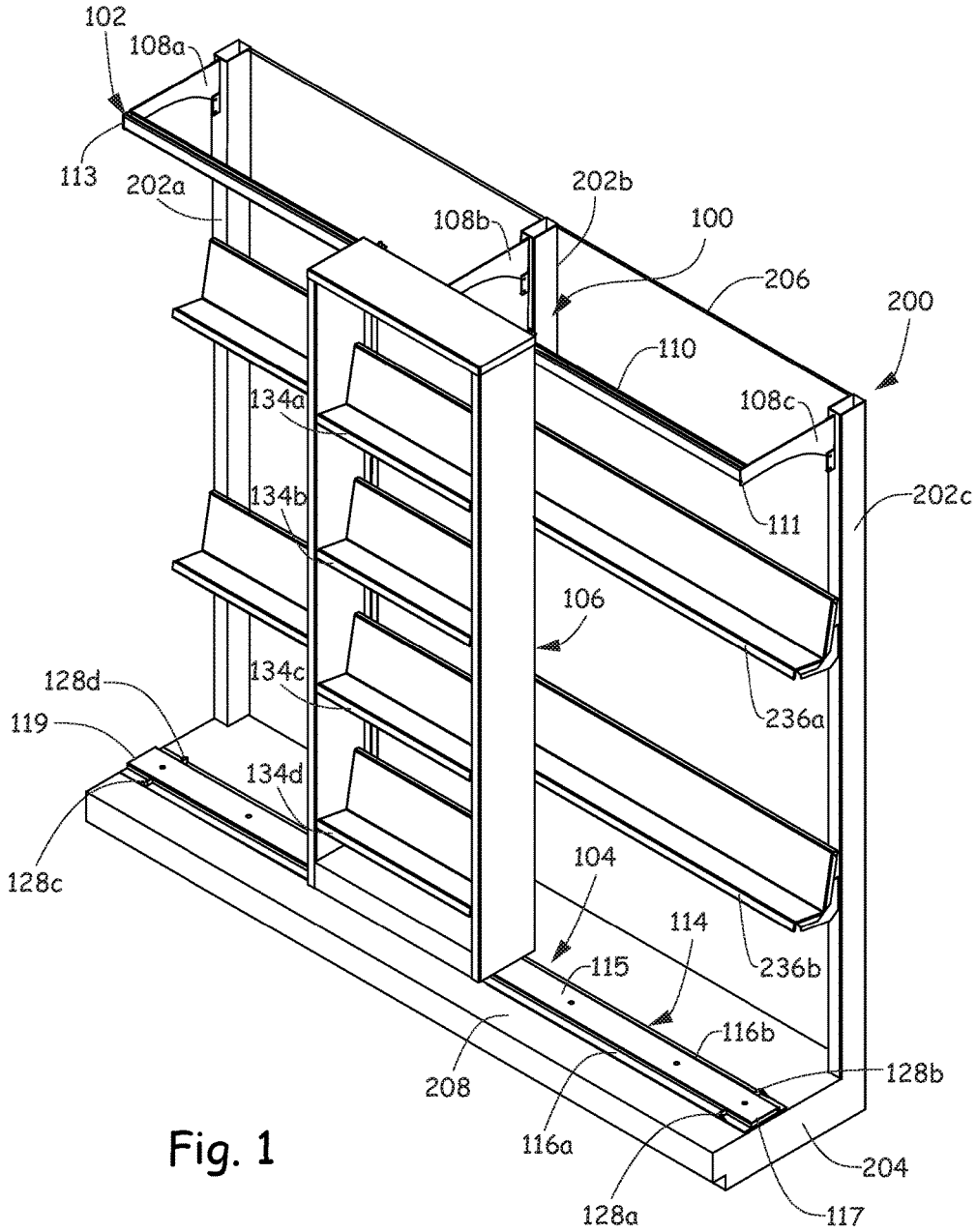
FIG. 1 is a front perspective view of an interactive display unit mounted to a fixed gondola display fixture according to an embodiment.
Figure 2:
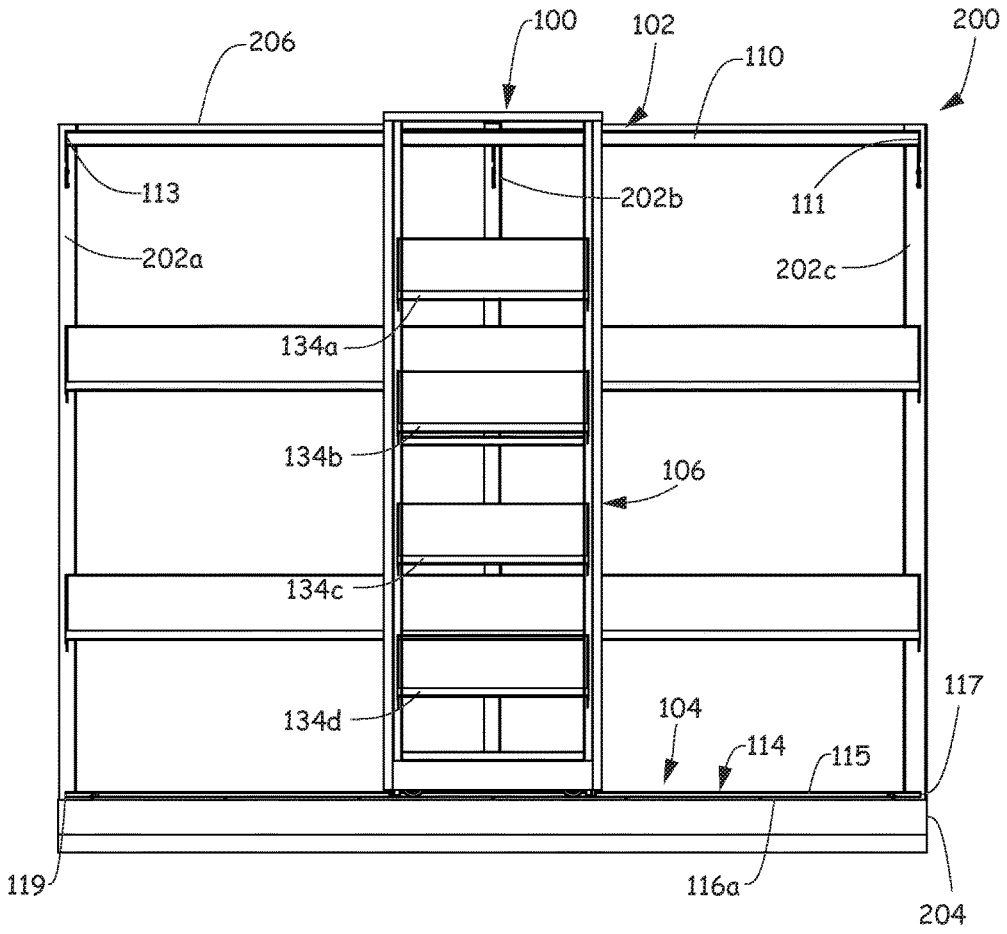
FIG. 2 is a front view of FIG. 1.
Figure 3:
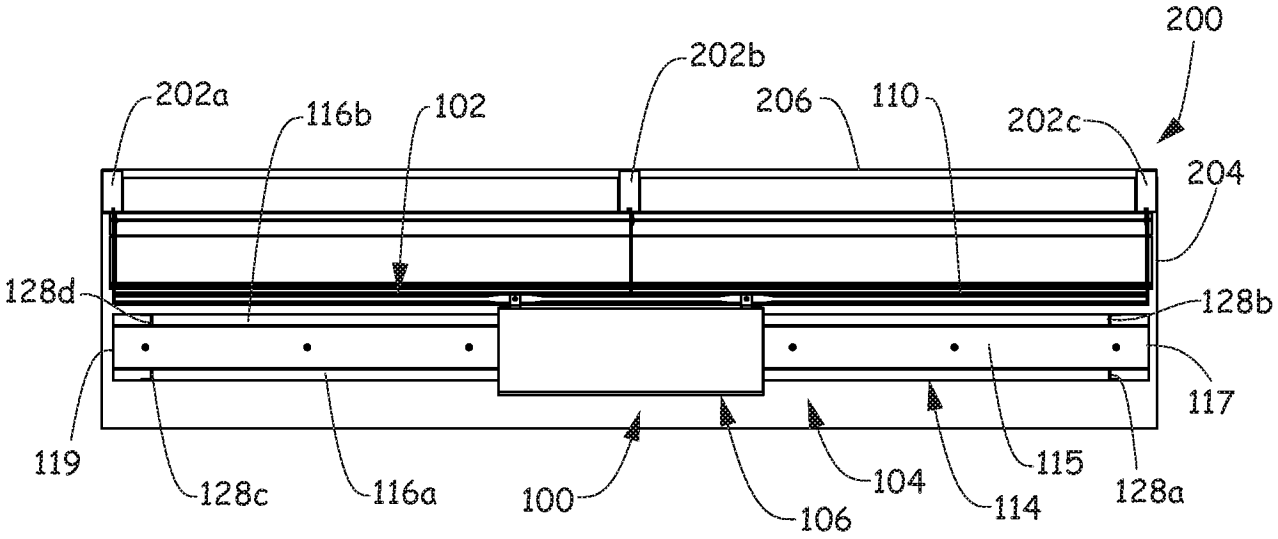
FIG. 3 is a top view of FIG. 1.
Figure 4:
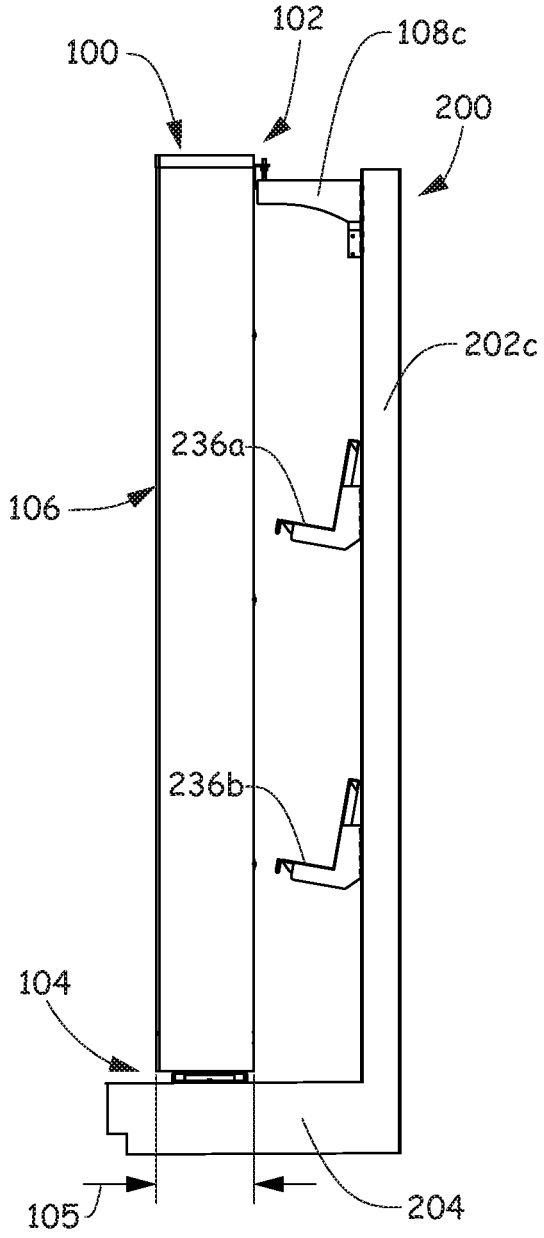
FIG. 4 is a right side view of FIG. 1.

FIG. 1 is a front perspective view of an interactive display unit 100 mounted to a fixed gondola display fixture 200 according to an embodiment. FIG. 2 is a front view, FIG. 3 is a top view and FIG. 4 is a right side view of FIG. 1. Fixed gondola display fixture 200 includes uprights 202*a*, 202*b* and 202*c*, a base deck 204 and a back wall 206 supported by uprights 202*a*, 202*b* and 202*c*. Mounted to fixed gondola display fixture 200 is interactive display unit 100. Interactive display unit 100 includes an upper rail assembly 102, a lower track and roller assembly 104 and a movable case 106.

Figure 5:
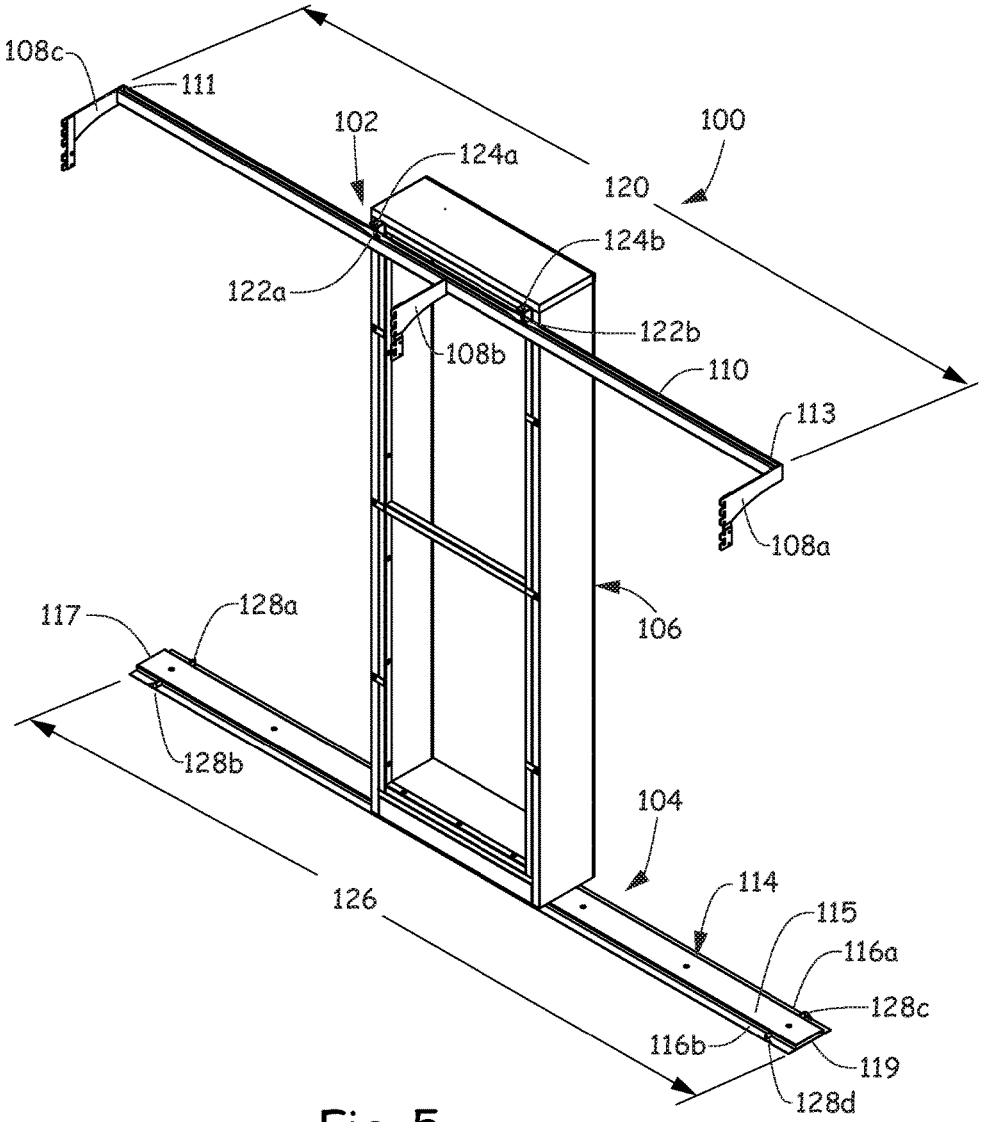
FIG. 5 is a back perspective view of the interactive display unit of FIG. 1 without the gondola display fixture according to an embodiment.
Figure 6:
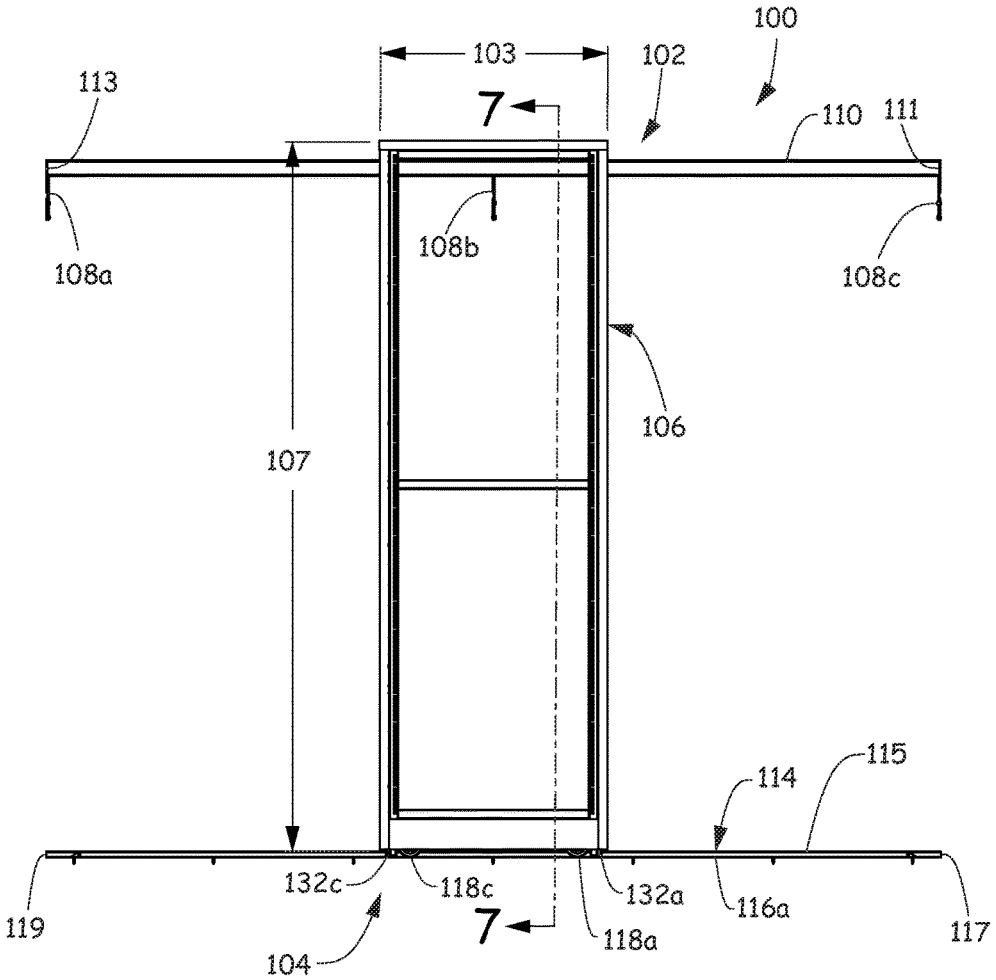
FIG. 6 is front view of FIG. 5.
Figure 7:
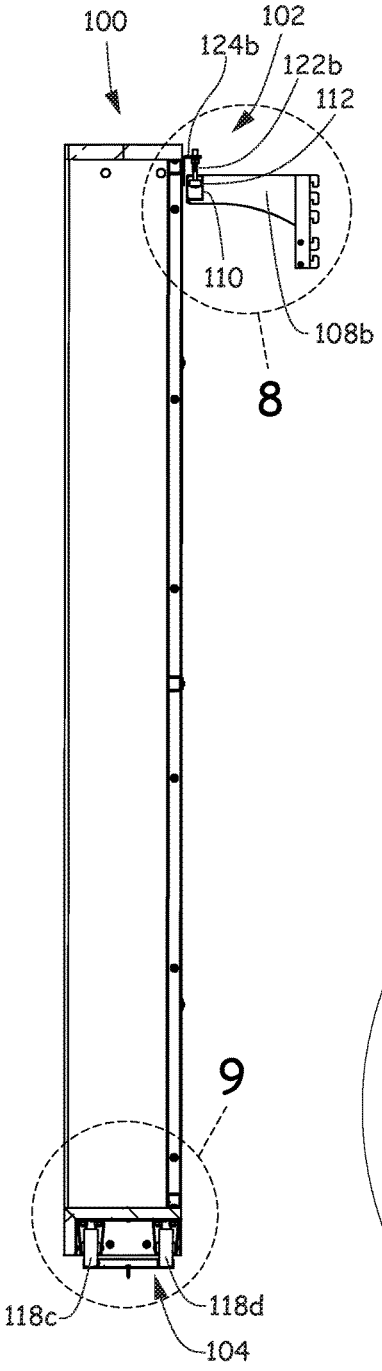
FIG. 7 is a section view of the interactive display unit taken through the section line in FIG. 6.
Figure 10:
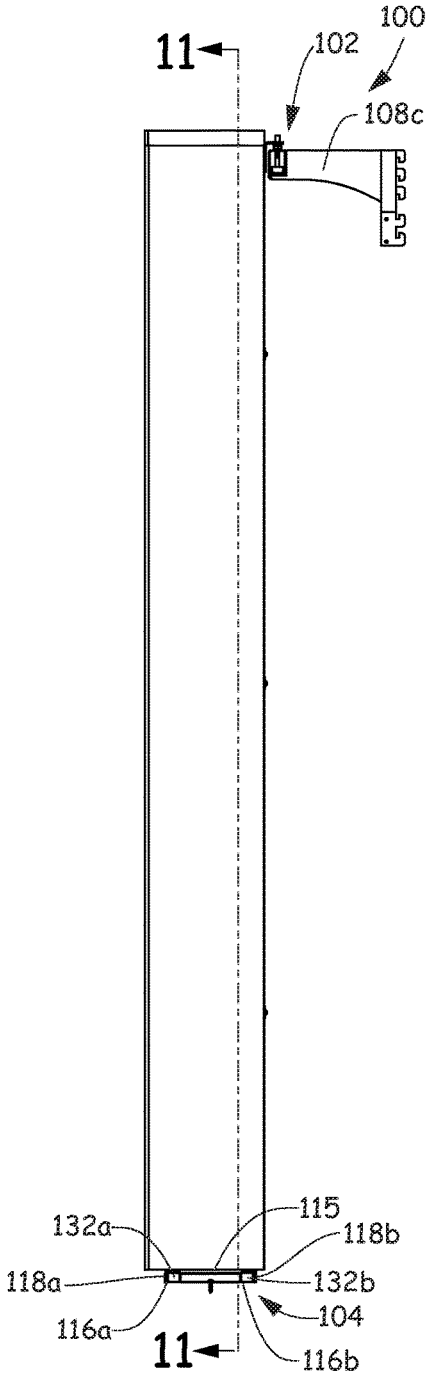
FIG. 10 is a right side view of FIG. 5.
Figure 11:
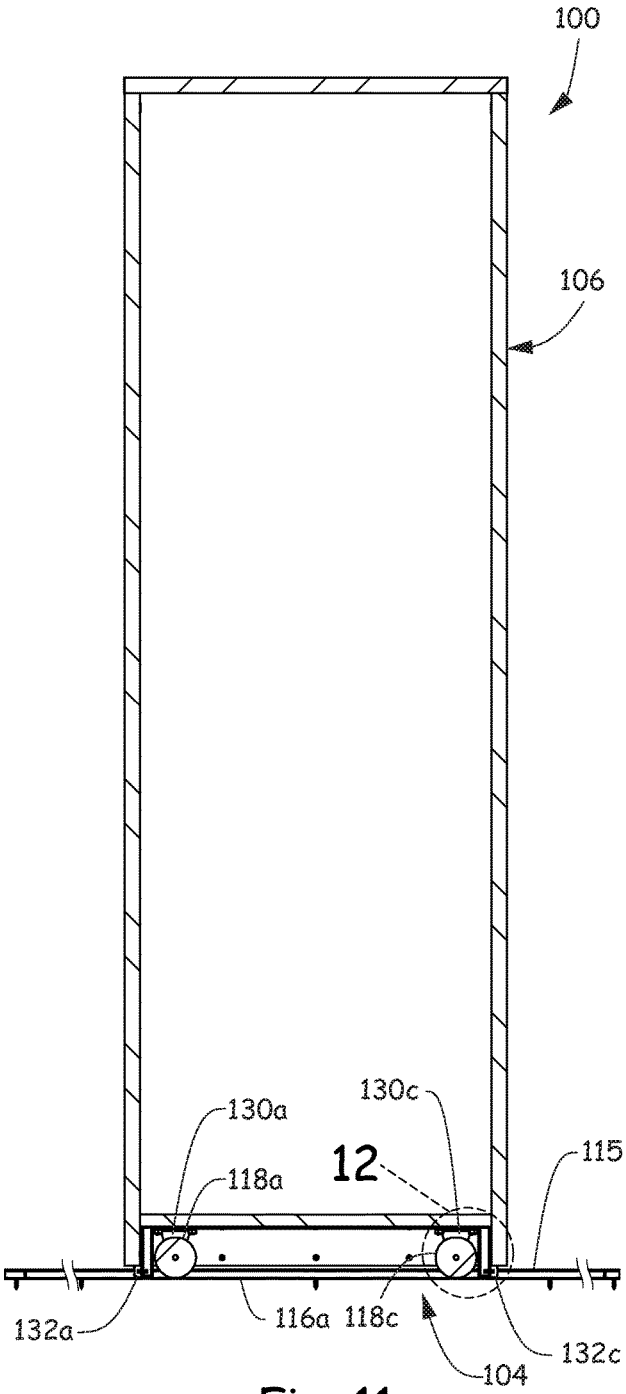
FIG. 11 is a section view of the interactive display unit taken through the section line in FIG. 10.

FIG. 5 is a back perspective view of interactive display unit 100 of FIG. 1 without gondola display fixture 200 according to an embodiment. FIG. 6 is a front view of interactive display unit 100, FIG. 7 is a section view of interactive display unit 100 taken through the section line in FIG. 6, FIG. 10 is a right side view of interactive display unit 100 and FIG. 11 is a section view of interactive display unit 100 taken through the section line in FIG. 10. Movable case 106 has a width dimension 103 (FIG. 6), a depth dimension 105 (FIG. 4), a height dimension 107 (FIG. 6) and a plurality of shelves 134*a-d* (FIGS. 1 and 2).

Figure 8:
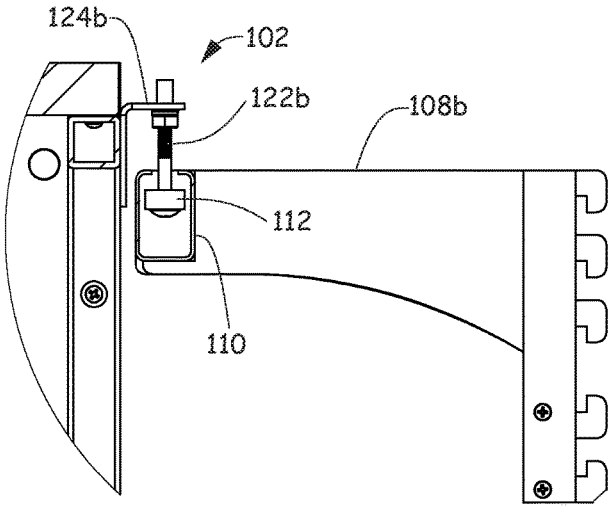
FIG. 8 is an enlarged view of the portion indicated in FIG. 7.

Upper rail assembly 102 includes a rail 110 having a first end 111 and an opposing second end 113 and is mounted to uprights 202*a*, 202*b* and 202*c* of fixed gondola display fixture 200 with a plurality of corresponding brackets 108*a*, 108*b* and 108*c*. Upper rail assembly 102 also includes at least one bearing 112 (FIGS. 7 and 8) that slidably couples an upper top end of movable case 106 to rail 110. Under one embodiment, upper rail assembly 102 includes a first bearing (not illustrated) and a second bearing 112 (FIGS. 7 and 8). Each bearing (112) slidably couples movable case 106 to rail 110 through a fastener 122*a* (FIG. 5) and 122*b* (FIGS. 5, 7 and 8) and respective support members 124*a* (FIG. 5) and 124*b* (FIGS. 5, 7 and 8). In particular, each fastener 122*a* and 122*b* connects the at least one bearing (112) to the respective support member 124*a* and 124*b* that is directly coupled to movable case 106. Each bearing (112), corresponding fastener 122*a* or 122*b* and corresponding support member 124*a* or 124*b* is spaced apart lengthwise along movable case 106 from each other and are configured to move movable case 106 in a horizontal direction from left to right or in a horizontal direction from right to left along rail 110.

As shown in FIGS. 1-3, 5 and 6, rail 110 has a length 120 and brackets 108*a*, 108*b* and 108*c* support and mount rail 110 to uprights 202*a*, 202*b* and 202*c* of fixed gondola display fixture 200 along its length 120. For example, bracket 108*a* mounts second end 113 of rail 110, bracket 108*c* mounts opposing first end 111 of rail 110 and bracket 108*b* mounts a point or midpoint along length 120 of rail 110 between first end 111 and second end 113.

FIG. 8 is an enlarged view of the portion indicated in FIG. 7, which is of upper rail assembly 102 in FIG. 7. In FIGS. 7 and 8, the section line indicated in FIG. 6 provides a side view of bracket 108*b*, second bearing 112 located in rail 110, fastener 122*b* and support member 124*b*. FIGS. 7 and 8 also provide section views of movable case 106 and rail 110. Fastener 122*b* couples bearing 112*b* to support member 124*b* and therefore movable case 106. In particular, support member 124*b* has a base portion that is directly attached to movable case 106 and a cantilevered portion that is extends from the base portion to receive fastener 122*b*. Upon applying a force to movable case 106, the bearings (112) slide along length 120 of the interior of rail 110 to move movable case 106 back and forth relative to fixed gondola display fixture 200.

Lower track and roller assembly 104 includes a track 114 having a first end 117 that corresponds with first end 111 of rail 110 and an opposing second end 119 that corresponds with second end 113 of rail 110. Track 114 further includes a guide 115 and a pair of wheel wells 116*a* and 116*b* located on opposing sides of guide 115. A plurality of wheels 118*a*, 118*b*, 118*c* and 118*d* are mounted to a bottom of movable case 106. Wheels 118*a* and 118*b* are aligned and separated depthwise along movable case 106 so that each wheel 118*a* and 118*b* is located in respective wheel well 116*a* and 116*b* of track 114 and therefore on opposing sides of guide 115. Wheels 118*c* and 118*d* are also aligned and separated depthwise along movable case 106 so that wheels 118*c* and 118*d* are located in respective wheel wells 116*a* and 116*b* of track 114 and therefore on opposing sides of guide 115. In addition, wheels 118*a* and 118*c* are aligned and separated widthwise along movable case 106 so that wheels 118*a* and 118*c* are located in and spaced apart in the same wheel well 116*a* and wheels 118*b* and 118*d* are aligned and separated widthwise along movable case 106 so that wheels 118*b* and 118*d* are located in and spaced apart in the same wheel well 116*b*.

As shown in FIGS. 1-3, 5 and 6, track 114 has a length 126 that extends from first end 117 to opposing second end 119. The entire length 126 of track 114, which also includes the entire length of guide 115 and wheel wells 116*a* and 116*b*, is mounted to a top surface 208 of base deck 204 of gondola display fixture 200. Movable case 106 is configured to simultaneously move along rail 110 of upper rail assembly 102 and track 114 of lower track and roller assembly 104. In particular, movable case 106 moves between first end 111 of rail 110 and corresponding first end 117 of track 114 and second end 113 of rail 110 and corresponding second end 119 of track 114.

As illustrated in FIGS. 1, 3, 5, track 114 includes stoppers 128*a*, 128*b*, 128*c* and 128*d*. Stoppers 128*a* and 128*b* are located closer to first end 117 of track 114 than second end 119 and are spaced apart from first end 117 of track 114 by the same distance. Stopper 128*a* is located in wheel well 116*a* and stopper 128*b* is located in wheel well 116*b*. Stoppers 128*c* and 128*d* are located closer to second end 119 of track 114 than first end 117 and are spaced apart from second end 119 of track 114 by the same distance. Stopper 128*c* is located in wheel well 116*a* and stopper 128*d* is located in wheel well 116*b*. Stoppers 128*a*, 128*b*, 128*c* and 128*d* will be discussed in more detail below.

Figure 9:
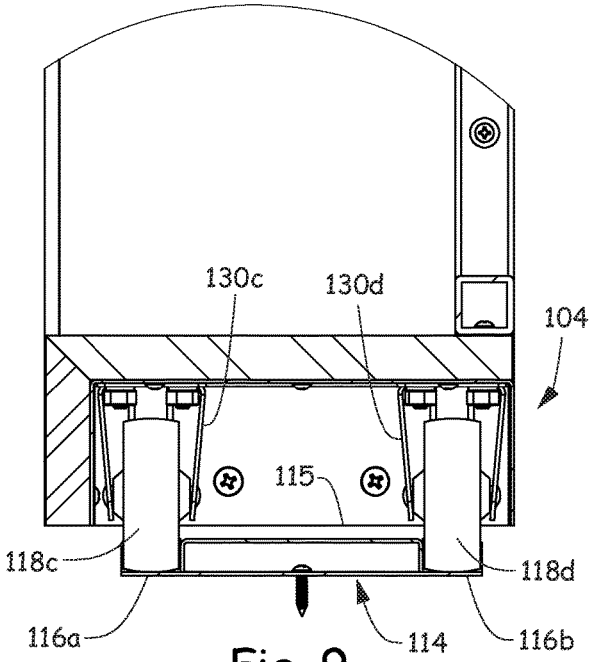
FIG. 9 is an enlarged view of the portion indicated in FIG. 7.
Figure 12:
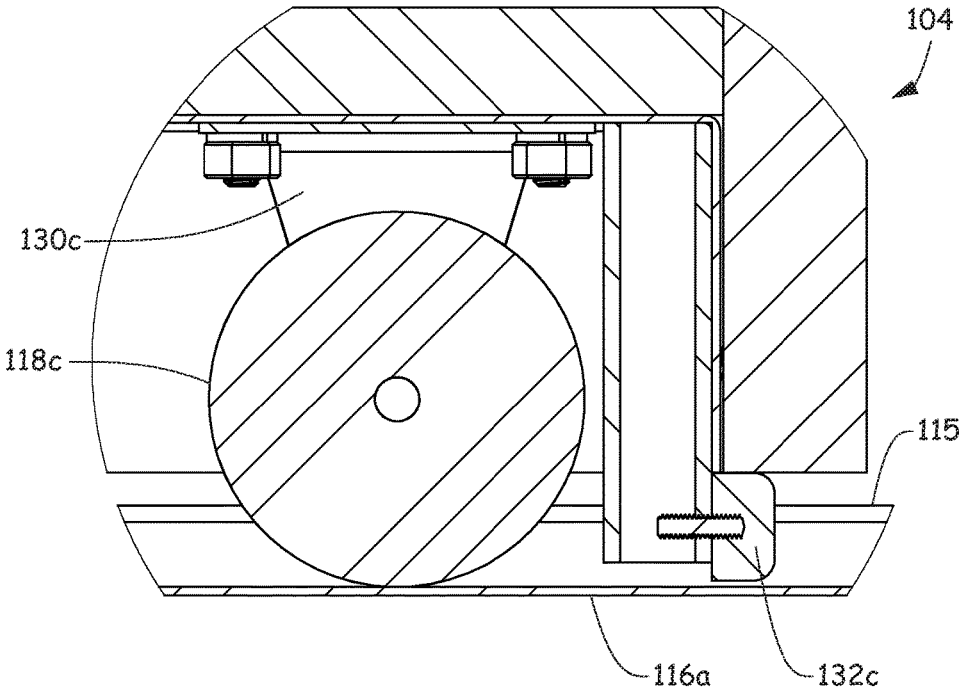
FIG. 12 is an enlarged view of the portion indicated in FIG. 11.

FIG. 9 is an enlarged view of the portion indicated in FIG. 7, which is of lower track and roller assembly 104. FIG. 12 is an enlarged view of the portion indicated in FIG. 11, which is of lower track and roller assembly 104. In FIGS. 7 and 9, the section views provide a side view of wheels 118*c* and 118*d* mounted to the bottom of movable case 106 with respective mounts 130*c* and 130*d*. Also in FIGS. 7 and 9, the section views provide section views of movable case 106, track 114 including guide 115 and wheel wells 116*a* and 116*b*. In FIG. 11, the section view provides a back view of a portion of mounts 130*a* and 130*c* (130*c* being enlarged in FIG. 12) and provides section views of wheels 118*a* and 118*c* (118*c* being enlarged in FIG. 12). Furthermore, in FIG. 11, the section view provides a side view of bumpers 132*a* and 132*c* (132*c* being enlarged in FIG. 12).

Wheels 118*a*, 118*b*, 118*c* and 118*d* are mounted to a bottom of movable case 106 by mounts 130*a*, 130*b*, 130*c* and 130*d* and are configured to move movable case 106 along length 126 of track 114, but are restricted to the distance located between stoppers 128*a* and 128*c* and 128*b* and 128*d* by a plurality of bumpers 132*a* and 132*c* and bumpers 132*b* and 132*d*. Bumpers 132*a*, 132*b*, 132*c* and 132*d* are each coupled to and extend from the bottom of movable case 106. Adjacent to each wheel 118*a*, 118*b*, 118*c* and 118*d* is a respective one of the plurality of bumpers 132*a*, 132*b*, 132*c* and 132*d* and each bumper 132*a*, 132*b*, 132*c* and 132*d* is positioned outwardly from its respective wheel 118*a*, 118*b*, 118*c* and 118*d*. The term "outwardly" is defined as being on the side of the wheel that is located closest to the outer perimeter of movable case 106.

Upon a user moving movable case 106 to the right side of fixed gondola display fixture 200, bumpers 132*a* and 132*b* come in direct contact with stoppers 128*a* and 128*b* so as to prevent movable case 106 from moving off track 114 at first end 117. Likewise, upon a user moving movable case 106 to the left side of gondola display fixture 200, bumpers 132*c* and 132*d* come in direct contact with stoppers 128*c* and 128*d* so as to prevent movable case 106 from moving off track 114 at second end 119.

With reference back to FIGS. 1-4, movable case 106 includes a plurality of shelves 134*a*, 134*b*, 134*c* and 134*d*. While movable case 106 includes four shelves 134*a-d*, it should be realized that movable case 106 may include any number of shelves for displaying merchandise. In addition, fixed gondola display fixture 200 also includes a plurality of rows of shelves 236*a* and 236*b* that are coupled to uprights 202*a*, 202*b* and 202*c* and run along back wall 206. While the uprights 202*a-c* of fixed gondola display fixture 200 illustrated in FIGS. 1-4 are supporting only two rows of shelves 236*a* and 236*b*, it should be realized that uprights 202*a-c* may support and fixed gondola display fixture may include any number of rows of shelves.

Merchandise located on shelves 134*a-d* of movable case 106 are configured to be located closer to a customer than merchandise located on the rows of shelves 236*a* and 236*b* mounted to fixed gondola display fixture 200 and in front of a portion of the rows of shelves 236*a* and 236*b* mounted to fixed gondola display fixture 200. The portion of the rows of shelves 236*a* and 236*b* that are blocked by movable case 106 and its shelves 134*a-d* changes as movable case 106 moves along rail 110 of upper rail assembly 102 and track 114 of lower track and roller assembly 104. In other words, merchandise located behind movable case 106 may, for the moment, be less accessible to the customer, but upon customer interaction with movable case 106 to move movable case 106 along rail 110 and track 114 relative to fixed gondola display fixture 200 the merchandise previously located behind movable case 106 is revealed to the customer and becomes accessible.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above ar e disclosed as example forms of implementing the claims.

What is claimed is:

1. An interactive retail structure comprising:

a gondola display fixture having a base deck and a plurality of uprights;

a movable case including a right side panel, a left side panel, an upper panel that couples tops of the right and left side panels, a base that couples bottoms of the right and left side panels, a back, a front and a plurality of shelves located between the upper panel and the base, the front and the back and extending from the right side panel to the left side panel;

an upper rail assembly comprising:

a rail mounted to the uprights on the gondola display fixture with brackets including a first end, an opposing second end and a channel having an opening that extends from the first end to the opposing second end of the rail along an upper side of the rail so that the opening of the channel faces upwardly;

at least one support member that is directly coupled to the back of the movable case;

at least one fastener coupled to the support member and extending through the upwardly facing opening and into the channel;

at least one bearing located within the channel and coupled to the at least one fastener, wherein the at least bearing slidably moves the movable case between the first end and the opposing second end of the rail;

a lower track and roller assembly comprising:

a track having a first end corresponding with the first end of the rail and an opposing second end corresponding with the second end of the rail; and a plurality of wheels mounted to a bottom of the movable case that engage with the track; and wherein the at least one bearing moves the movable case along the rail between the first end and the opposing second end of the rail and the plurality of wheels move the movable case between the first end and the second end of the track.

2. The interactive retail display unit of claim 1, wherein the track is mounted to a top surface of the base deck of the gondola display fixture and includes first and second wheel wells located on opposing sides of a guide.

3. The interactive retail display unit of claim 2, further comprising a plurality of bumpers each coupled to and extending from the bottom of the movable case, wherein adjacent each of the wheels includes a respective one of the plurality of bumpers and each bumper is positioned outwardly from its respective wheel.

4. The interactive retail display unit of claim 3, wherein the track further comprises a plurality of stoppers each located in and attached to one of the wheel wells, wherein for each bumper that extends from the bottom of the movable case there is a corresponding stopper in one of the wheel wells that is configured to prevent the wheels from moving beyond the stoppers in the wheel wells when directly contacted with its respective bumper.

5. The interactive retail display unit of claim 1, wherein the movable case and the plurality of shelves of the movable case are configured to be located in front of a portion of a plurality of rows of shelves mounted to the uprights on the gondola display fixture, wherein the portion of the plurality of rows of shelves mounted to the uprights of the fixed gondola display fixture that are blocked by the movable case changes as the movable case is moved along the rail of the upper rail assembly and the track of the lower track and roller assembly.

6. The interactive retail display unit of claim 1, wherein the at least one bearing comprises a pair of bearings, the at least one fastener comprises a pair of fasteners and the at least one support member comprises a pair of support members, wherein each bearing connects to one of the fasteners and each fastener connects to one of the support members and each support member is directly coupled to the back of the movable case at spaced apart locations.

7. An interactive retail structure comprising:

a fixed gondola display fixture including a base deck having a top surface, a plurality of uprights, a back wall and shelves configured to display product;

an interactive display unit mounted to the gondola display fixture, the interactive display unit comprising:

a movable case including a right side panel, a left side panel, an upper panel that couples tops of the right and left side panels, a base that couples bottoms of the right and left side panels, a back, a front and a plurality of shelves located between the upper panel and the base and extending from the right side panel to the left side panel configured to display product, wherein the movable case is located in front of a portion of the shelves on the gondola display fixture to highlight the products displayed by the movable case with respect to the products displayed by the gondola display fixture;

an upper rail assembly including a rail mounted with brackets to the plurality of uprights and having a first end, an opposing second end and a channel having an opening that extends from the first end to the opposing second end of the rail and at least one bearing slidably coupling the back of the movable case to the rail so that a top of the upper panel of the movable case is free of the upper rail assembly;

a lower track and roller assembly including a track mounted to the top surface of the base deck having a first end corresponding with the first end of the rail and an opposing second end corresponding with the second end of the rail;

wherein the movable case is configured to move along the rail of the upper rail assembly and the track of the lower track and roller assembly relative to the fixed gondola display fixture to reveal merchandise located behind the movable case.

8. The interactive retail structure of claim 7, wherein the movable case is further configured to move along the rail and the track between the first end of the rail and corresponding first end of the track and the second end of the rail and the corresponding second end of the track.

9. The interactive retail structure of claim 7, wherein the track comprises first and second wheel wells located on opposing sides of a guide and wherein the lower track and roller assembly further comprises a plurality of wheels mounted to a bottom of the movable case, wherein at least a first wheel engages with the first wheel well and a second wheel engages with the second wheel well.

10. The interactive retail display unit of claim 9, wherein the lower track and roller assembly further comprises a plurality of bumpers each coupled to and extending from the bottom of the movable case, wherein adjacent each of the wheels includes a respective one of the plurality of bumpers and each bumper is positioned outwardly from its respective wheel.

11. The interactive retail display unit of claim 10, wherein the track further comprises a plurality of stoppers each located in and attached to one of the wheel wells, wherein for each bumper that extends from the bottom of the movable case there is a corresponding stopper in one of the wheel wells that is configured to prevent the wheels from moving beyond the stoppers in the wheel wells when directly contacted with its respective bumper.

12. The interactive retail display unit of claim 7, wherein the upper rail assembly further comprises at least one fastener that connects the at least one bearing to at least one support member that is directly coupled to the back of the movable case.

13. The interactive retail display unit of claim 12, wherein the at least one bearing comprises a pair of bearings, the at least one fastener comprises a pair of fasteners, the at least one support member comprises a pair of support members, wherein each bearing connects to one of the fasteners and each fastener connects to one of the support members and each support member is directly coupled to the back of the movable case at spaced apart locations.

14. A method of interacting with a retail structure comprising:

moving a movable case that is mounted to a fixed gondola display fixture by:

sliding the movable case along a rail of an upper rail assembly that is mounted with brackets to a plurality of uprights of the gondola display fixture; and simultaneously rolling the movable case along a track mounted to a top surface of a base deck of the gondola display fixture;

wherein the movable case includes a right side panel, a left side panel, an upper panel that couples tops of the right and left side panels, a base that couples bottoms of the right and left side panels, a back, a front and a plurality of shelves located between the upper panel and the base and extending from the right side panel to the left side panel, wherein the back of the movable case is slidably coupled to the rail so that a top of the upper panel of the movable case is free of the upper rail assembly;

wherein the movable case is located in front of a portion of the rows of shelves mounted to the plurality of uprights on the fixed gondola display fixture to highlight the products displayed by the movable case with respect to the products displayed by the rows of shelves of the fixed gondola display fixture; and wherein moving the movable case along the rail and the track includes revealing the products located behind the movable case that are displayed by the rows of the fixed gondola display fixture.

15. The method of claim 14, wherein sliding the movable case along the rail mounted to the plurality of uprights of the gondola display fixture comprises sliding the movable case along the rail with at least one bearing.

16. The method of claim 15, wherein the at least one bearing is coupled, by a fastener, to at least one support member that is directly coupled to the back of the movable case.

17. The method of claim 14, wherein rolling the movable case along the track mounted to the top surface of the base deck comprises rolling the movable case along the track with a plurality of wheels mounted to a bottom of the movable case, wherein at least a first wheel engages with a first wheel well of the track and a second wheel engages with a second wheel well of the track.

* * * * *